United States Patent [19]

Hatfield

[11] Patent Number: 4,932,237

[45] Date of Patent: Jun. 12, 1990

[54] PORTABLE CRIMPING APPARATUS

[75] Inventor: John G. Hatfield, Camp Hill, Pa.

[73] Assignee: AMP Incorporated, Harrisburg, Pa.

[21] Appl. No.: 222,654

[22] Filed: Jul. 21, 1988

[51] Int. Cl.[5] ..... B25B 28/00

[52] U.S. Cl. ..... 72/452; 72/414; 72/454; 29/751

[58] Field of Search ..... 29/243.56, 751; 72/409, 72/407, 410, 414, 416, 452, 454

[56] References Cited

U.S. PATENT DOCUMENTS

| | | | |
|---|---|---|---|
| 2,075,162 | 3/1937 | Begg | 72/454 |
| 2,224,708 | 12/1940 | Van Siffert | 72/452 |
| 2,829,549 | 4/1958 | Demler | 29/751 |
| 3,386,298 | 6/1968 | Klinger | 72/410 |
| 3,397,567 | 8/1968 | Klinger | 72/410 |
| 3,406,558 | 10/1968 | Tillmann et al. | 29/751 |
| 3,423,987 | 1/1969 | Klinger | 72/410 |
| 3,469,434 | 9/1969 | Davis | 72/452 |
| 4,306,443 | 12/1984 | Matsutani | 72/452 |
| 4,464,924 | 8/1984 | Kralowetz | 72/452 |
| 4,475,374 | 10/1984 | Sakai et al. | 72/452 |
| 4,707,913 | 11/1987 | Moline | 72/416 |

FOREIGN PATENT DOCUMENTS

| | | | |
|---|---|---|---|
| 731349 | 4/1966 | Canada | 72/454 |
| 1001012 | 12/1976 | Canada | 72/452 |
| 3207063 | 11/1982 | Fed. Rep. of Germany . | |

*Primary Examiner*—David Jones

*Attorney, Agent, or Firm*—James M. Trygg

[57] ABSTRACT

A battery powered portable crimping apparatus is provided for crimping a terminal onto a wire. The crimping mechanism imposes a substantially constant torque on the electric motor during the crimping cycle thereby conserving battery energy. A pair of anvil-die sets are provided for crimping two different size terminals. The two dies are arranged to reduce the hazard of inadvertently inserting a foreign object into one of the anvil-die set openings while the other anvil-die set is engaged in crimping a terminal.

18 Claims, 5 Drawing Sheets

PORTABLE CRIMPING APPARATUS

The present invention relates to a battery powered portable compressing apparatus of the type suitable for crimping a terminal onto a wire.

BACKGROUND OF THE INVENTION

Portable crimping apparatus currently in use in the industry for crimping terminals onto electrical wires are typically powered by hydraulic or compressed air actuators or electric motors of the type requiring an external power source. These hand tools necessarily require an air hose or electrical cable connecting the hand tool to a power source thereby adversely affecting the tool's convenience and utility.

One such hand tool utilizing an electric motor for crimping terminals onto wires is disclosed in U.S. Pat. No. 3,397,567 which issued Aug. 20, 1968 to Klingler. The Klingler disclosure is representative of a number of portable crimping tools utilizing electric motors or pneumatic actuators which require connection to an outside power source. Another portable crimping tool utilizing an electric motor is disclosed in U.S. Pat. No. 4,475,374 which issued Oct. 9, 1984 to Sakai et al. Of particular interest, Sakai et al. discloses a relationship of crimping force to cam lift that is substantially linear while the terminal is being deformed and then after the crimping die has bottomed out, the cam continues to lift a small amount causing the force to peak substantially higher while the apparatus deforms slightly.

None of these references is concerned with battery powered portable tools and the accompanying problem of early discharge of the battery. This can be a serious problem in field use when facilities for recharging may be limited. The present invention addresses this problem by utilizing a novel concept and structure to maintain substantially constant torque requirements for the electric motor during the complete crimping cycle thereby eliminating peak loads which contribute to early discharge of the battery. Since peak loads are eliminated, a smaller, more efficient motor may be used.

SUMMARY

The present invention relates to an electrically powered compressing device, such as a terminal crimping tool. The device has a frame, a ram slidably contained in the frame for reciprocating movement along a ram path, and an actuator means for causing the ram to move in one direction along the ram path. The actuator means includes a housing assembly pivotally mounted on the frame on a housing axis substantially normal to the ram path. An electric motor is attached to the housing assembly, having an output shaft coupled to a power screw which extends from the housing assembly. A nut is in threaded engagement with the power screw and is arranged to traverse a portion thereof. A cam is rotationally mounted on the frame for angular movement about a cam axis which is substantially parallel to the housing axis, the cam having a cam surface extending over an acute angle within the permitted angular movement of the cam. A cam follower is associated with the ram and is in operational engagement with the cam surface. Means is provided for eccentrically coupling the nut to the cam so that upon operation of the electric motor, the power screw rotates causing the nut to traverse the portion of the power screw, the housing to pivot about the housing axis, and the cam to rotate only through the acute angle thereby effecting the movement of the ram.

DESCRIPTION OF THE PREFERRED EMBODIMENT

Figure 1:
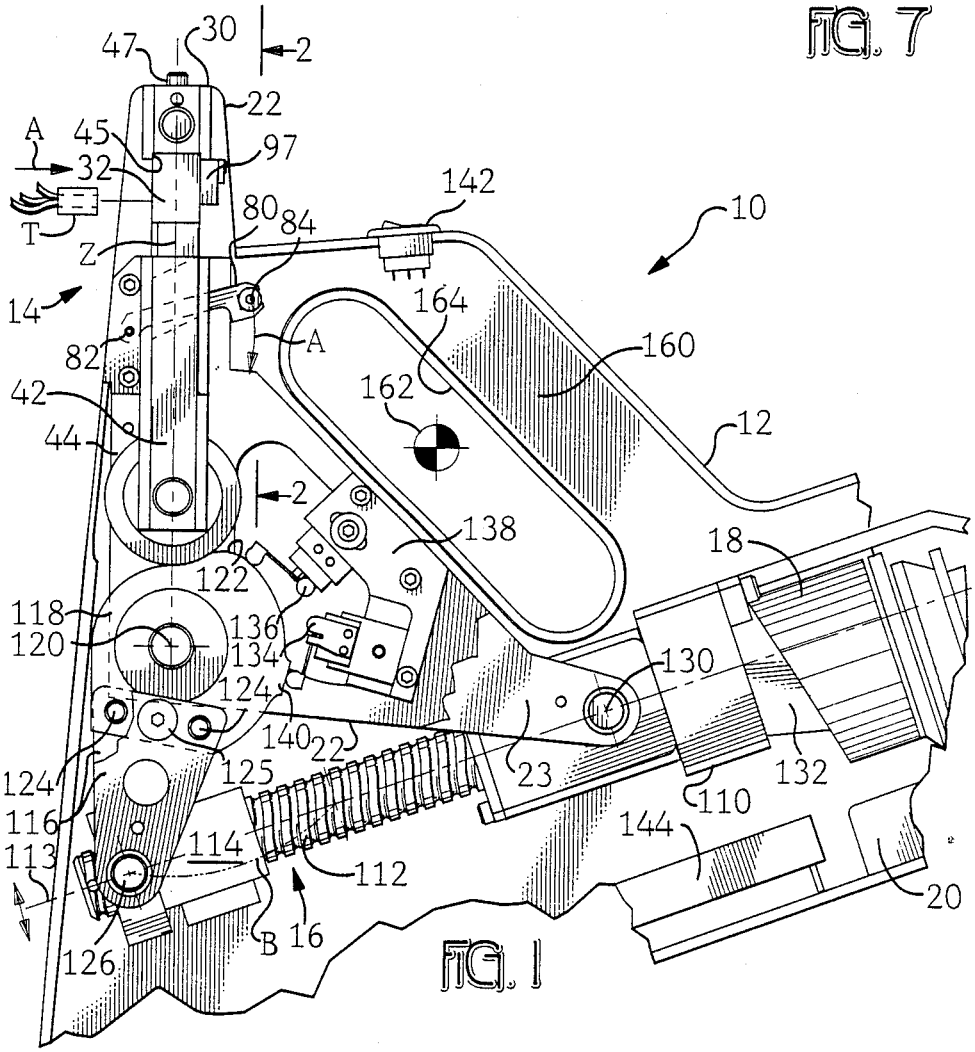
FIG. 1 is a partial cutaway view of a portable crimping tool utilizing the teachings of the present invention.

FIG. 1 is a partial cutaway showing a portable crimping apparatus 10 having a housing 12, a terminal crimping means 14, and an actuator means 16 for actuating the terminal crimping means 14. An electric motor 18 powered by a battery 20 is disposed within the housing 12 and arranged to drive the actuator means 16 in a manner which will be described below. The battery 20 is suitably arranged within the housing 12 so that it may be easily replaced or recharged.

Figure 2:
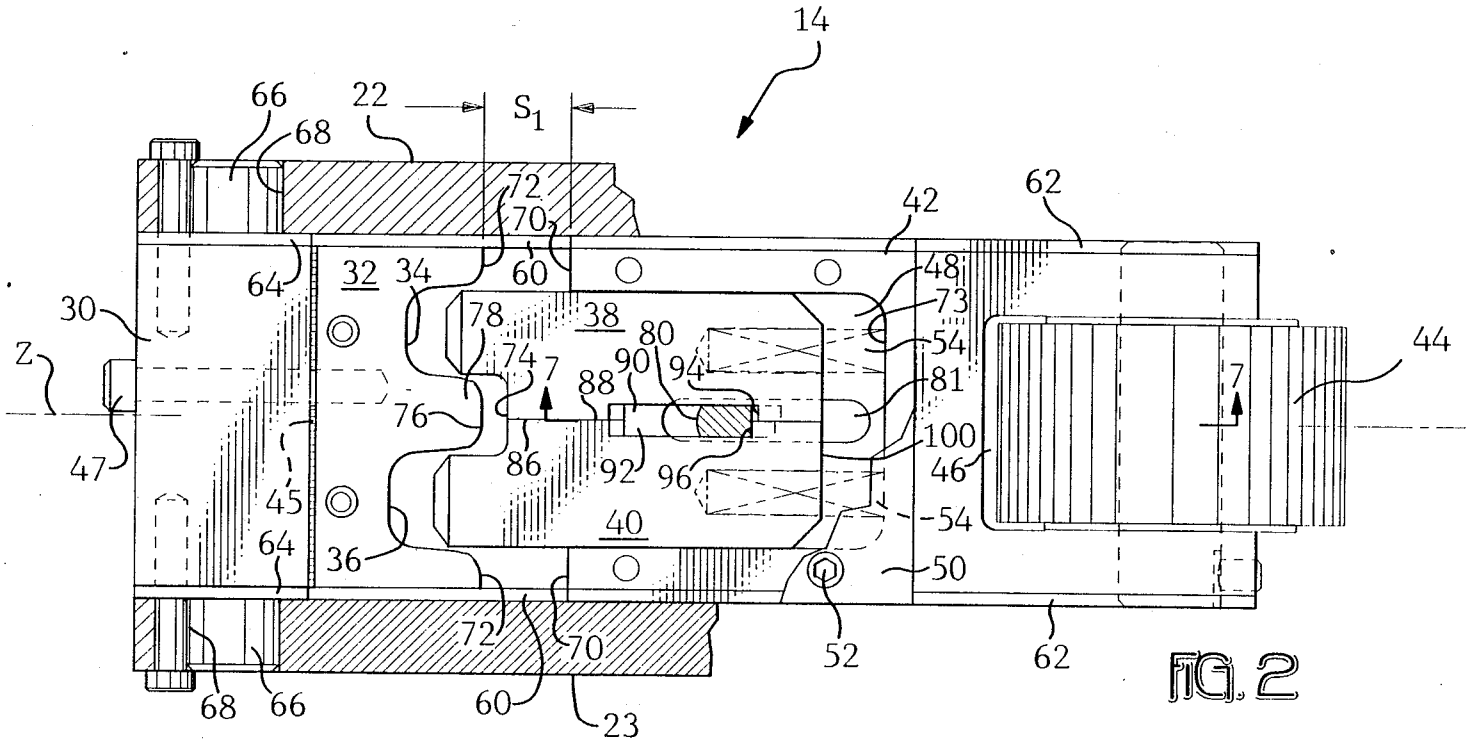
FIG. 2 is a partial cross section view taken along the line 2—2 of FIG. 2 showing the terminal crimping means.

As best seen in FIGS. 1 and 2, a pair of L-shaped frame members 22 and 23, one being a mirror image of the other, are rigidly fastened in opposing relation, to the housing 12 by suitable screw fasteners, or other means, and are arranged to support the terminal crimping means 14 and the actuator means 16.

The terminal crimping means 14 consists of a support block 30, an anvil block 32 containing a pair of terminal crimp anvils 34 and 36, a pair of dies 38 and 40, a ram 42, and a cam follower 44. The anvil block 32 engages a locating slot 45 in the support block 30 and is secured there by a screw fastener 47. The cam follower is journaled for rotation in a cutout 46 in an end of the ram 42. The opposite end of the ram 42 contains a cavity 48 which is sized to slidingly receive the pair of dies 38 and 40, as best seen in FIG. 2. A cavity cover plate 50 is fastened to the ram 42 with four screw fasteners 52 and serves to restrict sliding movement of the dies 38 and 40 to movement toward and away from the anvils 34 and 36 respectively. A pair of resilient members 54, coil compression springs in the present example, are arranged to urge the pair of dies 38 and 40 toward their respective anvils 34 and 36. The pair of L-shaped frame members 22 and 23 each include a slot 60 for slidingly receiving the rails 62 formed on either side of the ram 42, as best seen in FIG. 2. The members 22 and 23 are spaced within the housing 12 so that the ram 42 is free to undergo movement along its longitudinal axis indicated as Z in FIG. 1, thereby defining a ram path. The support block 30 includes a pair of locating rails 64 which are sized to be received by the slots 60 in the two frame members 22 and 23, as shown in FIG. 2. A cylindrical portion 66 projects from each end of the support block 30 adjacent the locating rails 64. These cylindrical portions 66 engage the bores 68 formed in the two frame members 22 and 23 thereby securing the support block 30 against any movement with respect to the frame members 22 and 23.

As is shown in FIG. 2, the ram 42 is fully retracted to the right with respect to the anvil block 32 indicated by the space S1 between the abutting surfaces 70 and 72 of the ram 42 and block 32 respectively. The actuating means 16 is arranged to urge the ram 42 along the axis Z toward the anvil block 32 until the surfaces 70 abuttingly engage the surfaces 72.

As explained above, the springs 54 are arranged to urge the dies 38 and 40 in a direction toward their respective anvils 34 and 36 to a closed position as shown in FIG. 2. The die 38 and anvil 34 thereby form a first anvil-die set and the die 40 and anvil 36 form a second anvil-die set. The springs 54 project from blind holes disposed in the ends of the dies 38 and 40 furthest from the anvils 34 and 36 as shown in FIG. 2, and are in contact with a wall 73 of the cavity 48. The dies 38 and 40 are limited in their movement toward their anvils by a pair of shoulders 74 and 76 respectively which abut a die stop 78 projecting from the anvil block 32. The shoulders 74 and 76 and the die stop 78 are arranged so that when the shoulders are in abutting engagement with the die stop, as shown in FIG. 2, the dies 38 and 40 are properly spaced from their respective anvils 34 and 36 for crimping a terminal onto a wire. Note that the springs 54 also urge the wall 73 of the cavity 48, and therefore the ram 42, in a direction away from the dies 38 and 40 and toward and into engagement with the actuator means 16, which will be explained below.

Figure 7:
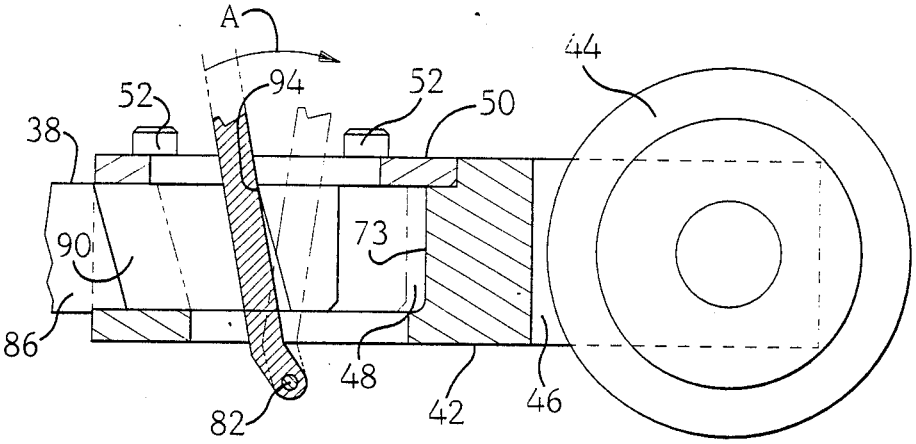
FIG. 7 is a partial cross section view taken along the line 7—7 of FIG. 2 showing the die retraction mechanism.
Figure 9:
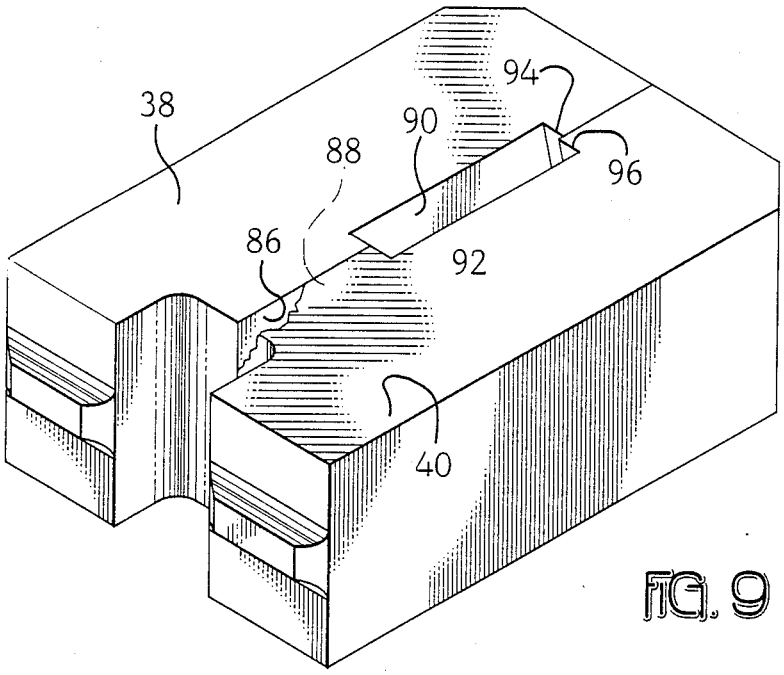
FIG. 9 is an isometric view of the pair of dies.

A retraction means for moving the dies 38 and 40 away from their anvils 34 and 36 in opposition to the springs 54, includes a retracting lever 80 pivotally attached to the frame members 22 and 23 at 82 and having a pin 84 which projects laterally of the lever 80 and through the housing 12. The pin 84 may be a dowel pin or tab suitable for depressing manually thereby causing the lever 80 to pivot about the point 82 in a direction indicated by the arrow A in FIG. 1. A clearance slot 81 is formed in the bottom of the ram 42 to permit passage of the lever 80 therethrough as shown in FIG. 2. A corresponding slot, not shown, is also provided in the cover plate 50. As is best seen in FIGS. 2 and 9 the two dies 38 and 40 each have a surface 86 and 88 respectively in mutual sliding engagement. Each surface 86 and 88 has an opening or relief 90 and 92 respectively formed therein which are mutually opposing when the dies 38 and 40 are in their closed position as shown in FIG. 2. The openings 90 and 92 have edges 94 and 96 respectively which terminate the openings at the upper surface of the dies 38 and 40, see FIG. 9. These edges 94 and 96 are engaged by the lever 80 when retracting the dies 38 and 40 to their open position as shown in FIG. 7. The pivot 82 is disposed so that as the lever 80 is pivoted in the direction of the arrow A, the points of engagement with the edges 94 and 96 act as pivot points with very little sliding action between the lever 80 and the edges 94 and 96. While, in the present example, the edges 94 and 96 are engaged by the lever 80 for retracting the dies 38 and 40, other suitable projections associated with the openings 90 and 92 may be used, including a pin or boss formed within or adjacent each opening.

Figure 3:
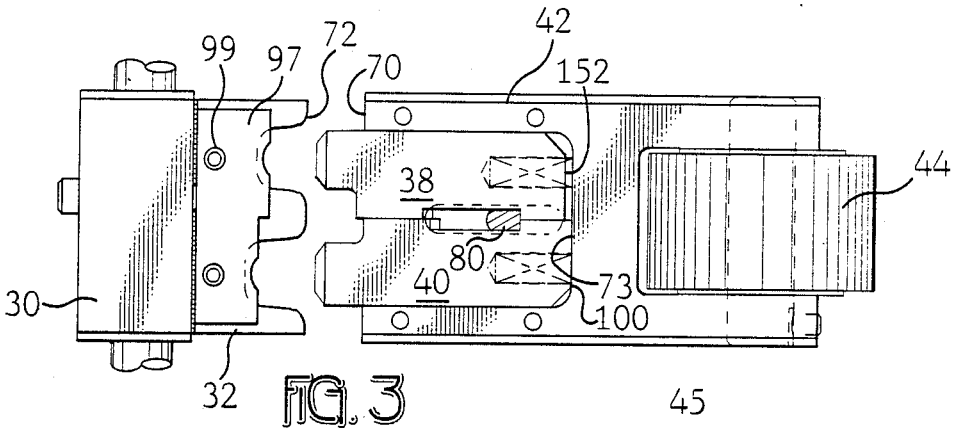
FIGS. 3, 4, and 5 are views similar to that of FIG. 2 showing the terminal crimping means in various operating positions.

In operation, the retraction lever 80 is pivoted in the direction of the arrow A by manually depressing the pin 84. The lever 80, being in engagement with the edge 96, causes the die 40 to begin moving away from its anvil 36. As the lever 80 continues to move in the direction of the arrow A, it engages the edge 94, causing the die 38 to also begin moving away from its anvil 34. This movement continues until the right most surface 100 of the die 40 abuts the wall 73 at which point, the dies 38 and 40 are in their open position with respect to their anvils. Note that when the dies 38 and 40 are in their closed position, as shown in FIG. 2, the edge 96 is displaced a small amount to the left with respect to the edge 94. This results in the die 38 being retracted a lesser amount than the die 40 when the dies 38 and 40 are in their open position, as shown in FIG. 3. The reasons for this difference will be explained below. A terminal locating means comprising a plate 97, as best seen in FIGS. 1 and 3, is fastened to the anvil block 32 by the screw fasteners 99. The plate 97 is arranged to function as a limit stop for the terminal T when the terminal is inserted into the opening between a die 38, 40 and its respective anvil. Further, the plate 97 is somewhat resilient to absorb a slight expansion as the terminal deforms during crimping. In the present example, the plate 97 is made from urethane but may be made from any suitable resilient material.

The actuator means 16 consists of a housing assembly 110, a threaded shaft, or power screw, 112 having a longitudinal axis 113 and extending from the housing assembly 110, a nut 114 in threaded engagement with the shaft 112, a cam 118 journaled for rotation in the pair of L-shaped frame members 22 and 23, and a pair of links 116 which interconnect the cam 118 and the nut 114 in a manner described below. The housing assembly axis 130 is disposed so that the axis 113 of the threaded shaft 112 preferably forms an acute angle with respect to the ram path axis Z for reasons set forth below. The motor 18 is attached to the housing assembly 110 in any suitable manner. The cam 118 is journaled for rotation about a cam axis 120, as shown in FIG. 1, which is approximately disposed along the longitudinal axis Z of the ram 42 between the follower 44 and the threaded shaft 112, and, therefore, is in alignment with the permitted movement of the ram 42 and its associated cam follower 44. As set forth above, the springs 54 urge the ram 42 in a direction toward and into engagement with the actuator means 16. More particularly, the follower 44 is urged into cam following engagement with a cam surface 122 of the cam 18. It is important that friction be reduced to a minimum level, particularly if the tool is powered by a small motor. In the disclosed embodiment, roller bearings are used for the cam 118, and the end of the screw is supported with ball bearings in the housing assembly 110. The screw and nut combination 112,114 has ball bearings in the nut 114 and may be obtained from existing manufacturers. The disclosed embodiment is provided with a Model R-30 ball screw and nut manufactured by Rockford Ball Screw Company of Rockford, Ill. 61109.

The pair of links 116 are rigidly attached at one end thereof to the cam 118 by any suitable means such as the pair of dowel pins 124 and the screw fastener 125. The other end of each of the pair of links 116 is pivotally attached to opposite sides of the nut 114, shown at 126 in FIG. 1. The housing assembly 110 is pivotally attached to the L-shaped frame members 22 and 23 at a housing axis 130, and is the support for the motor 18 and the threaded shaft 112. This permits the motor 18, housing assembly 110, threaded shaft 112, and nut 114 to pivot as a unit about the housing axis 130. This is an important characteristic as will be described below. Additionally, the housing axis 130 is substantially normal to the ram path. A coupling within the housing assembly 110 rotationally couples the threaded shaft 112 to the output shaft of a gear reduction portion 132 of the electric motor 18. Any suitable rotational coupling device that is well known in the industry may be used for this purpose. The Practice of the invention requires that the motor be relatively small, particularly if the tool is to be portable, and the motor will, therefore, have a low torque. A relatively high torque is required to rotate the cam 118, therefore, the reduction gear unit 132 is therefore an important element in the apparatus. Good results have been obtained with the motor and reduction gear unit of a Model 1940 ⅜" reversible cordless drill manufactured by Black & Decker (U.S.) of Towsen, Md. 21204, see Black & Decker Power Tools and Accessories Catalogue, 1987–88. The motor and reduction gear unit of the 1940 drill are described in detail in a publication of the Black & Decker Company, see Black & Decker Bulletin No. 9868 (Jan. 87-CO), Form No. 230533-01.

An important detail in a compressing device in accordance with the present invention is the arc through which the cam 118 is rotated. This arc should be kept to a minimum in order that the upward force exerted by the screw and nut on the cam 118 will always be near the axis Z of the ram, which extends vertically in FIG. 1, substantially through the pivot axis 120 of the cam 118. This arc is about 45 degrees in the embodiment shown, and in any case should be less than 90 degrees thereby defining an acute angle. This relatively small arc requires, in turn, that the arm defined by the links 116 be relatively long. This arm constitutes an eccentric coupling between the nut 114 and the cam 118.

Figure 5:
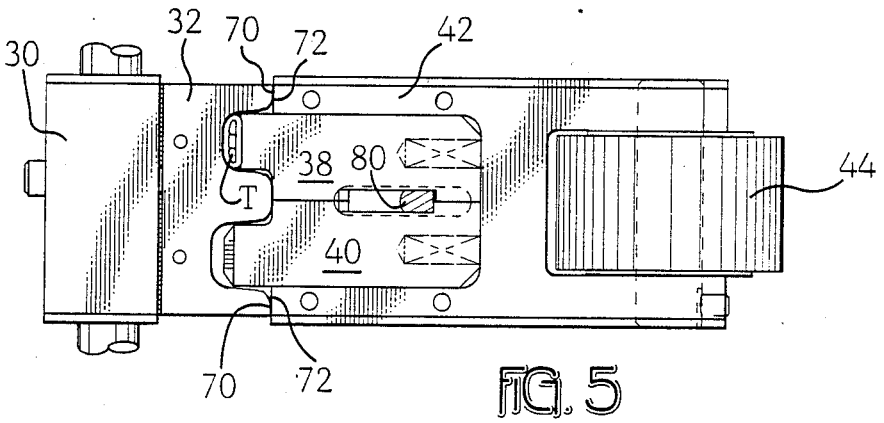
Figure 8:
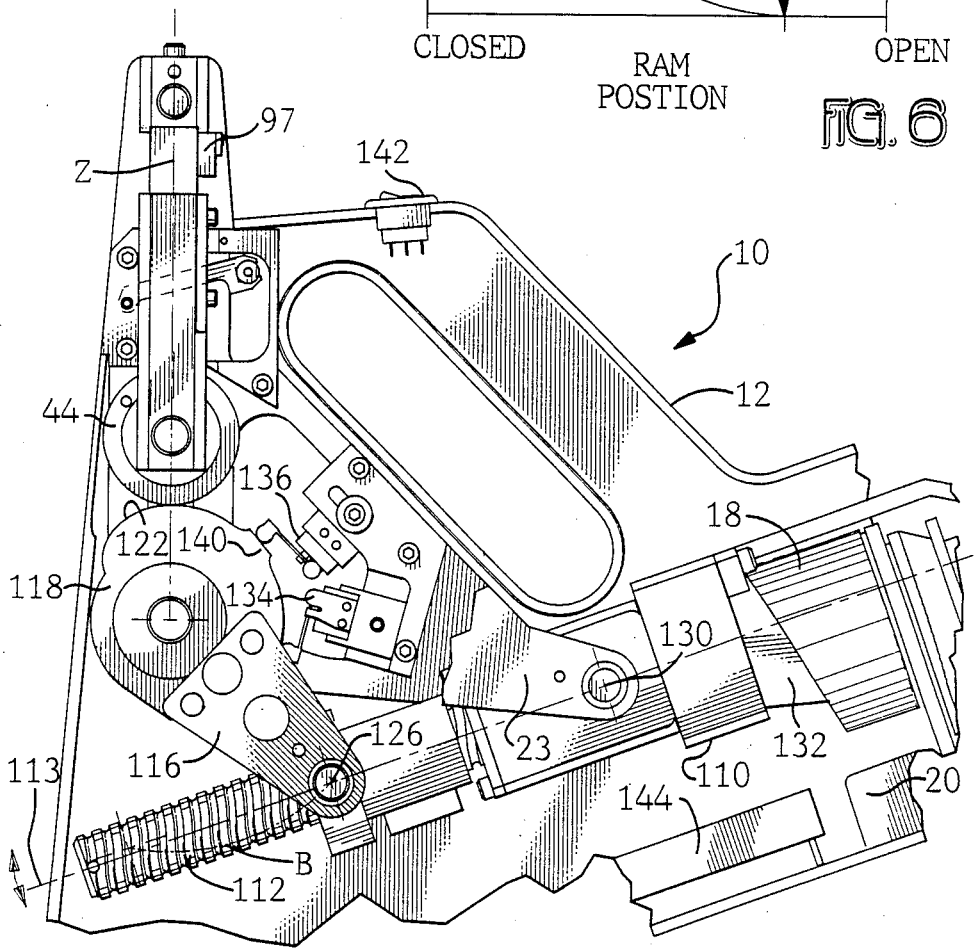
FIG. 8 is a view similar to that of FIG. 1 showing the ram fully extend.

A pair of limit switches 134 and 136, adjustably secured to a bracket 138 in any suitable manner, are arranged to engage a position indicating bar 140. The bar 140 is a raised portion in the periphery of the cam well beyond the cam surface 122. The limit switch 134 is arranged to be electrically activated by the bar 140 when the cam 118 is positioned so that the ram 42 is completely retracted as shown in FIGS. 1 and 2. The limit switch 136, on the other hand, is arranged to be electrically activated by the bar 140 when the cam 118 has advanced the ram 42 to its fully closed position where the surfaces 70 of the ram abut the surfaces 72 of the anvil block 32, as shown in FIGS. 5 and 8. The limit switches 134 and 136 work in cooperation with a manually operated trigger switch 142 and a controller 144 to control the operation of the portable crimping apparatus.

The controller 144, is interconnected in a logical arrangement with the trigger switch 142, the limit switches 134 and 136, the electric motor 18, and battery to control the operation of the apparatus 10. In the present example, the controller 144 is a set of logically interconnected relays, however, it may comprise solid state devices or other suitable structure. Operation of the trigger switch 142 activates the controller 144 which operates the motor 18 in the forward direction until a signal is received from the limit switch 136. The motor 18 is then dynamically braked to a stop and then operated in the reverse direction until a signal is received from the limit switch 134. The motor 18 is then dynamically braked to a stop. Once the trigger switch 142 is operated, the forward and reverse cycle of the motor 18, as described above, will proceed independent of whether or not the switch 142 is released, however, a new cycle will not be initiated until the switch 142 is released and then operated again.

The exact positions of the limit switches 134 and 136 are not critical since the cam 118 includes a dwell in the cam surface 122 at the points where the ram 42 is fully advanced, as shown in FIG. 8, and where the ram 42 is fully retracted, as shown in FIG. 1. This dwell establishes a rotational tolerance within which each limit switch 134 and 136 may be set.

Figure 4:
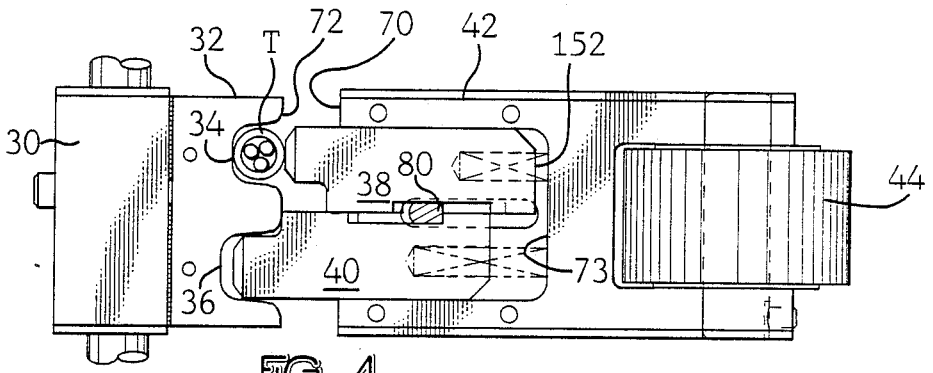

In operation, a group of wires to be terminated are properly stripped and inserted into an appropriately sized terminal T. The lever 80 is then manually pivoted in the direction of the arrow A, see FIG. 1, until the dies 38 and 40 are retracted to their open position shown in FIG. 3. Note that the rear surface 100 of the die 40 abuts the wall 73 of the cavity 48. The terminal T and associated wires are then inserted into the opening of the anvil-die set 34, 38 until the terminal engages the terminal locator 97. The lever 80 is then released permitting the die 38 to engage the terminal T and the die 40 to advance to its closed position as shown in FIG. 4. The trigger switch 142 is then depressed activating the controller 144 which operates the electric motor 18. As the screw shaft 112 rotates, the threaded nut 114 traverses the shaft 112 toward the motor 18 thereby rotating the cam 118 from the position shown in FIG. 1 to the position shown in FIG. 8, causing the motor 18, housing 110, shaft 112, and nut 114 to pivot as a unit about the pivot point 130, first in one direction and then the other, as the pivot point 126 of the links 116 follows the arc B of approximately 45 degrees. This effects the efficient transfer of the rotational power of the motor 18 to the rotation of the cam 118 without the need for expensive gear couplings or other similar complex structures. This rotation of the cam 118 causes the follower 44 and ram 42 to advance from the position shown in FIG. 4 to that shown in FIG. 5, thereby crimping the terminal T onto the group of wires. At this point the limit switch 136 is activated thereby signaling the controller 144 to reverse the direction of the motor to return the cam 118 and retract the ram to the positions shown in FIG. 1.

A handle 160 is formed in the housing 12 and disposed within the acute angle formed by the axis 113 of the threaded shaft 112 and the ram path axis Z, as shown in FIGS. 1 and 8. As will be appreciated by those skilled in the art, the acute angle formed by these two axes permits use of the tool in close quarters such as in the corners of rooms. The handle 160 is positioned between the axis 113 and the ram path axis Z to effect a good balance when the tool is being held while in use. Preferably, the center of gravity 162 of the crimping apparatus 10 will be located in approximate vertical alignment with and directly under the gripping portion 164 of the handle 160, as viewed in FIG. 1.

Figure 6:
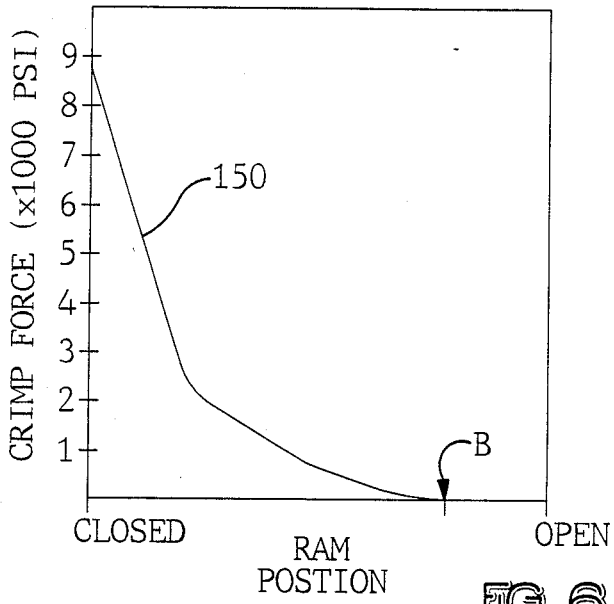
FIG. 6 is a graph depicting crimp force with respect to ram displacement.

An important advantage of the present invention is that the actuating mechanism 16 places a constant torque requirement on the motor 18 during the entire crimping cycle thereby conserving battery energy. FIG. 6 shows a graph 150 which depicts the force required to crimp a terminal onto a wire. Note that with the ram 42 in the fully retracted or open position, shown in FIG. 4, there is no force shown in the corresponding position of the graph 150. As the ram 42 advances until the wall 73 engages the surface 152 of the die 38, point B of the graph 150, a crimping force begins to appear. As the ram 42 continues to advance to the position shown in FIG. 5, the crimping force on the die 38 increases substantially in accordance with that depicted by the graph 150. The geometry of the cam surface 122, however, is chosen, in cooperation with the follower 44, link 116, and threaded shaft 112, to provide the required forces at the die 38 while maintaining a substantially constant torque requirement of the threaded shaft 112.

Another important advantage of the present invention is that the dies 38 and 40 are independently movable so that when retracted by the lever 80, a large terminal cannot be inserted into the opening of the anvil-die set 34, 38 which is intended to crimp a small terminal. Further, when a terminal is inserted into one anvil-die set and the lever 80 released, the die for the other anvil-die set is caused to close by the spring 54 thereby preventing the inadvertent insertion of a foreign object into the opening.

I claim:

1. An electrically powered compressing device, such as a terminal crimping tool, said device having a frame, a ram slidably contained in said frame for reciprocating movement along a ram path, and actuator means for causing said ram to move in one direction along said ram path, said actuator means comprising:

(a) a housing assembly pivotally mounted on said frame on a housing axis substantially normal to said ram path;

(b) an electric motor attached to said housing assembly, having an output shaft;

(c) a power screw coupled to said output shaft and extending from said housing assembly;

(d) a nut in threaded engagement with said power screw and arranged to traverse a portion thereof;

(e) a cam rotationally mounted on said frame for angular movement about a cam axis which is substantially parallel to said housing axis, said cam having a cam surface extending over an acute angle of said angular movement;

(f) a cam follower associated with said ram, in operational engagement with said cam surface; and (g) means for eccentrically coupling said nut to said cam so that upon operation of said electric motor, said power screw rotates causing said nut to traverse.said portion of said power screw, said housing to pivot about said housing axis and said cam to rotate only through said acute angle thereby effecting said movement of said ram.

2. The device according to claim 1 wherein said means for eccentrically coupling said nut to said cam is a link having one end rigidly attached to said cam and another end pivotally attached to said nut.

3. The device according to claim 2 wherein said ram path has a longitudinal axis which approximately intersects said cam axis.

4. The device according to claim 3 wherein said housing axis is laterally spaced from said longitudinal axis of said ram path.

5. The device according to claim 4 wherein said cam is between said cam follower and said power screw.

6. The device according to claim 5 wherein said power screw has a longitudinal axis which forms an acute angle with said axis of said ram path.

7. The device according to claim 6 including a handle for holding said device during operation thereof, said handle being disposal between said axes of said power screw and said ram path and within said acute angle.

8. The device according to claim 1 including terminal crimping means for crimping a terminal comprising:

(a) first and second anvils attached to said frame;

(b) first and second dies each being disposed opposite a respective one of said first and second anvils, and being slidable within said ram and including a resilient means for urging said die toward its respective anvil independent of the other die to a closed position, and retraction means for moving each of said first and second dies away from said anvils to an open position.

9. The apparatus according to claim 8 wherein said first and second dies include first and second projections respectively wherein said projections are mutually adjacent and said retraction means includes a manually operable lever movably attached to said frame and arranged to engage said projections and thereby cause said first and second dies to move to said open position in response to manual operation of said lever.

10. The apparatus according to claim 9 wherein said first and second dies each have a surface in mutual sliding engagement, each of said surfaces having a mutually opposing opening therein, and said first projection being associated with said opening of said first die and said second projection being associated with said opening of said second die.

11. The apparatus according to claim 10 wherein an edge of one of said openings is said projection associated that opening and is arranged so that said manually operable lever engages said edge and substantially pivots thereabout while causing said die to move to said open position.

12. The apparatus according to claim 11 wherein said first anvil and die form a first anvil-die set sized for crimping a terminal of one size and said second anvil and die form a second anvil-die set sized for crimping a terminal of a larger size.

13. The apparatus according to claim 12 wherein when manually operated, said lever engages said edge of said second die prior to engaging said edge of said first die so that said second die undergoes greater movement away from said second anvil than does said first die away from said first anvil.

14. The apparatus according to claim 13 including terminal locating means for positioning the terminal between said die and anvil preparatory to crimping.

15. A portable apparatus for crimping a terminal onto a wire comprising:

(a) terminal crimping means comprising:

(a1) a frame;

(a2) an anvil attached to said frame;

(a3) a ram slidable within said frame for reciprocating movement along a ram path; and (a4) a die, slidable within said ram for undergoing movement toward and away from said anvil, said ram having a cam follower associated therewith;

(b) actuator means for actuating said terminal crimping means including a cam journaled for rotation within said frame in engagement with said cam follower so that upon rotation of said cam, said ram undergoes movement along said ram path and said die undergoes said motion toward said anvil; and (c) an electric motor powered by a battery, said motor arranged to drive said actuator means for crimping a terminal onto a wire;

wherein said actuator means is arranged to impose substantially constant torque on said electric motor while crimping a terminal onto a wire thereby minimizing the drain on said battery.

16. The crimping apparatus according to claim 15 wherein said actuator means further includes:

(a) a threaded shaft being coupled to said motor and being rotationally driven thereby about its longitudinal axis;

(b) a nut in threading engagement with said threaded shaft;

(c) a link coupled to said cam and to said nut so that when said threaded shaft is rotated by said motor, said nut is caused to transverse said threaded shaft along said longitudinal axis, causing said link to rotate said cam.

17. The crimping apparatus according to claim 16 wherein said link is pivotally coupled to said nut and said threaded shaft is arranged to pivot about a point on said longitudinal axis.

18. The crimping apparatus according to claim 17 including terminal locator means for positioning the terminal between said die and anvil preparatory to crimping.

* * * * *